United States Patent [19]

Koehler

[11] 4,451,808

[45] May 29, 1984

[54] ELECTROMAGNET EQUIPPED WITH A MOVING SYSTEM INCLUDING A PERMANENT MAGNET AND DESIGNED FOR MONOSTABLE OPERATION

[75] Inventor: Gérard Koehler, Ville d'Avray, France

[73] Assignee: La Telemecanique Electrique, Nanterre Cedex, France

[21] Appl. No.: 458,907

[22] Filed: Jan. 18, 1983

[30] Foreign Application Priority Data

Jan. 20, 1982 [FR] France ..... 82 00792

[51] Int. Cl.[3] ..... H01F 7/08

[52] U.S. Cl. ..... 335/229; 335/230; 335/81

[58] Field of Search ..... 335/78, 80, 81, 86, 335/229, 230

[56] References Cited

U.S. PATENT DOCUMENTS

| | | | |
|---|---|---|---|
| 2,872,546 | 2/1979 | Babcock. | |
| 3,597,712 | 8/1971 | Nakagome et al. | |
| 4,142,166 | 2/1979 | Arnoux | 335/81 |
| 4,191,937 | 3/1980 | Koehler et al. | 335/230 |
| 4,206,431 | 6/1980 | Kimpel | 335/80 |

FOREIGN PATENT DOCUMENTS

| | | | |
|---|---|---|---|
| 378991 | 8/1973 | U.S.S.R. | 335/78 |
| 1807098 | 7/1969 | Fed Rep of Germany. | |
| 1328497 | 4/1962 | France. | |
| 2103649 | 8/1971 | France. | |

*Primary Examiner*—George Harris
*Attorney, Agent, or Firm*—Young & Thompson

[57] ABSTRACT

At least one coil partly surrounds a magnetic circuit consisting of a fixed yoke and a movable armature, the armature being constituted by a permanent magnet having pole faces adapted to carry pole-pieces which project on each side of the axis of magnetization. The electromagnet comprises a second permanent magnet interposed within the fixed yoke with a polarity such that the armature is urged towards the end or so-called rest position when the coil is not energized.

19 Claims, 13 Drawing Figures

ELECTROMAGNET EQUIPPED WITH A MOVING SYSTEM INCLUDING A PERMANENT MAGNET AND DESIGNED FOR MONOSTABLE OPERATION

This invention relates to an electromagnet equipped with a moving system and designed for monostable operation.

The present invention also relates to a method for adjusting the magnetic conditions of operation of an electromagnet of this type.

Permanent-magnet devices of known types usually comprise one or a number of coils partly surrounding a magnetic circuit which in turn comprises a fixed yoke and a movable armature. This armature can be composed of a permanent magnet whose pole-faces are adapted to carry pole-pieces which project on each side of the axis of magnetization of the magnet. Together with the ends of the fixed yoke, the above-mentioned pole-pieces constitute two air-gap zones. The magnetic forces developed within these zones tend to displace the armature towards either one end position or the other, depending on whether the coil is energized in a suitable direction or is not energized.

In the foregoing, it has been taken for granted that the yoke is fixed and that the armature is movable. It will be readily understood, however, that this mobility must be considered as relative and that the devices contemplated in this specification can also have a movable yoke and a fixed armature.

A device of this type obviously provides bistable operation since the magnetic circuit is closed on the permanent magnet in each end position of the armature.

It has been endeavored to obtain monostable operation by so arranging one of the air-gaps that, in one end position of the armature, the flux of the permanent magnet does not pass through the air-gap or passes through this latter only to a relatively slight extent, the effect thus achieved being to prevent stable locking in this position. By reason of possible remanence, however, it is necessary to provide a restoring means such as a spring in order to overcome this remanence and permit displacement of the armature to the point of its travel at which the restoring force of the magnet will cause the armature to continue its range of travel until it reaches its end position of rest, the action of gravity being taken into account if necessary.

Fitting of a spring of this type in position gives rise to complications both in assembly and adjustment. Furthermore, in the case of a relay or a switching device, if the above-mentioned restoring force is given partly by the compression reaction of electric contacts, the wear of the contacts during the service life of the device may reduce the restoring force until faulty operation occurs as a result of remanence.

It is also a known practice to design electromagnets for monostable operation by making use of electronic devices which include capacitors in particular. The disadvantage of such units, however, clearly lies in their complexity and cost.

The aim of the present invention is to produce an electromagnet of the above-mentioned monostable type which is not only simple and economical to construct but also ensures completely reliable operation.

This result is obtained in accordance with the invention by means of a second permanent magnet interposed within the fixed yoke with a polarity such that the armature is urged towards the end or so-called rest position when the coil is not energized.

This position is a stable position which is locked due to the two magnets being in series in the circuit formed by the yoke and the armature. When the coil is energized in a suitable direction, the armature is moved to its other end position and remains in that position as long as the coil is energized, then returns to the rest position when energization is discontinued.

In a preferred embodiment of the invention, the magnets are separated from each other by the coil in all positions of said magnets.

When the coil is energized, the flux produced by the coil acts in opposition to the fixed-magnet flux and causes this latter to close on a path other than the movable permanent magnet of the armature, thus unlocking the rest position.

In a preferred embodiment of the invention, the yoke comprises two half-yokes arranged in partly overlappng relation and each surrounding one end of the coil in order to cooperate with flat pole-pieces, at least one of which has bent-back end portions. Said pole-pieces are capable of moving transversely to the axis of the movable magnet and are slidably fitted within the coil. The fixed magnet is secured between the overlapping portions of the half-yokes.

In an improved embodiment of the invention, the axis of the movable magnet is transverse to the axis of the fixed magnet.

According to a second aspect of the invention, the method for adjusting the magnetic conditions of operation of the last-mentioned embodiment is distinguished by the fact that pulses of an external magnetic field are transmitted selectively to the movable magnet or to the fixed magnet. Since the axes of the magnets are transverse with respect to each other, a field which is oriented so as to affect the fixed magnet does not affect the movable magnet and conversely.

Other features of the invention will be more apparent upon consideration of the following description and accompanying drawings, wherein.

Figure 1:
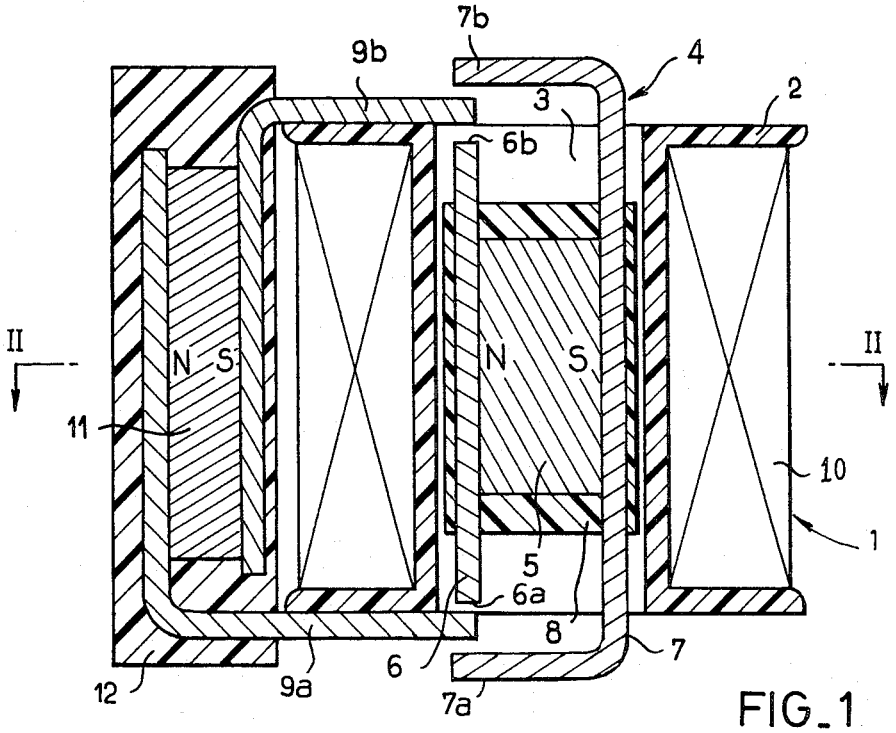
FIG. 1 is a longitudinal sectional view taken along the plane I—I of FIG. 2 and showing a first embodiment of an electromagnet in accordance with the invention.
Figure 2:
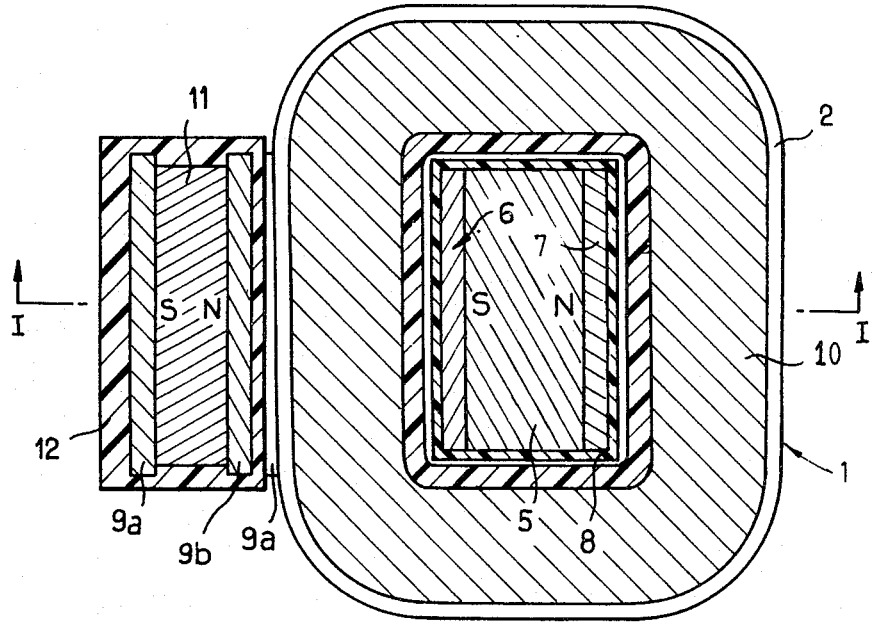
FIG. 2 is a sectional view taken along the plane II—II of FIG. 1.

Referring to FIGS. 1 and 2, an electromagnet in accordance with the invention comprises a coil unit 1 consisting of a winding 10 wound on a coil form 2 having a substantially rectangular axial cavity 3 in which an armature 4 is mounted for free displacement in sliding motion.

The armature 4 is illustrated in FIG. 1 in the mean position, which does not correspond to a stable operating position as will hereinafter become apparent.

Said armature comprises a permanent magnet 5 whose north-south magnetic axis is substantially perpendicular to the direction of sliding motion of the armature. The pole faces of said magnet are adapted to carry pole-pieces which are designated respectively by the reference numerals 6 and 7 and are bonded to said pole faces. The end portions 7*a* and 7*b* of the pole-piece 7 are bent-back substantially at 90° and thus brought into oppositely-facing relation to the end faces 6*a*, 6*b* of the flat pole-piece 6. With the exception of the ends of the pole-pieces, the complete armature is encapsulated in a block 8 of plastic material.

Two half-yokes 9*a*, 9*b* each surround one end of the coil unit 1 and partly overlap outside the coil unit in order to clamp a permanent magnet 11 between them. The components are assembled by encapsulation and the entire zone of overlap of the two half-yokes is embedded in a block 12 of plastic material. The axes of the movable magnet 5 and of the fixed magnet 11 are parallel to each other.

The polarity of the fixed magnet 11 is so determined as to ensure that the armature 4 is urged towards one of its end positions when the coil is not energized. In the case of the polarities indicated in FIG. 1, this position will be the top position of the armature and, by definition, will be the position of rest.

Figure 3:
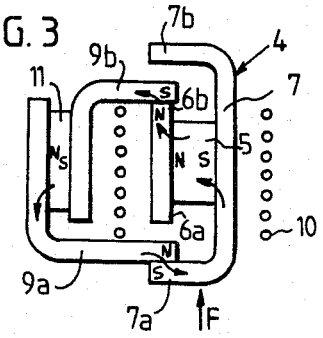
FIGS. 3 to 6 are simplified diagrams of the electromagnet of FIGS. 1 and 2 and are intended to explain its operation.

In this position, the end face 6*b* of the pole-piece 6 comes into contact with the half-yoke 9*b* and the bent-back end portion 7*a* of the pole-piece 7 comes into contact with the half-yoke 9*a*. In the magnetic circuit which is thus closed, the two permanent magnets are consequently in series (as shown in FIG. 3).

As will be readily apparent, the pole-pieces 6 and 7 are dimensioned and positioned in such a manner as to ensure that the two contacts mentioned above take place simultaneously.

A noteworthy point which results from this description is that, in all their relative positions, the magnets 5 and 11 are separated from each other by the coil.

Referring to FIGS. 3 to 6, the operation of said electromagnet will now be described in detail.

In the rest position (shown in FIG. 3), it has been seen in the foregoing that the armature 4 is urged by an upwardly directed force F in the case of the figure whilst the flux which passes through the coil also follows an upward path.

Figure 4:
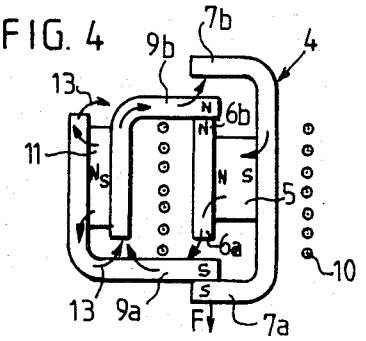

When the winding 10 is energized in the initial position of rest shown in FIG. 4 and assuming that said winding produces a downwardly directed flux, the flux through the fixed magnet 11 is restrained and caused to close on itself (as indicated by the arrows 13), which is facilitated by the short distance between the half-yokes 9*a* and 9*b*. This effect is primarily due to the fact that the two magnets are separated from each other by the coil.

The coil flux is closed in particular by the half-yoke 9*b* which is north-upward polarized as is also the case with the pole-piece 6. The closed air-gap 9*b*–6*b* therefore generates repulsive forces and the same applies to the closed air-gap 9*a*–7*a* for the same reason.

Correlatively, attractive forces appear within the open air-gaps 6*a*–9*a* and 7*b*–9*b* as a result of series connection of the flux through the movable magnet 5 and of the flux through the coil. Said coil flux is closed through the fixed air-gap which exists between the two half-yokes.

Figure 5:
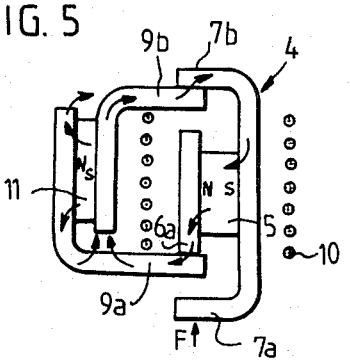

The force applied to the armature 4 is therefore directed downwards and has the effect of displacing said armature to its end work position (as shown in FIG. 5). In this position, the attractive forces are considerably increased as a result of closing of the air-gaps 9*b*–7*b* and 9*a*–6*a* whereas the repulsive forces have decreased as a result of opening of the air-gaps in which said forces are exerted.

Figure 6:
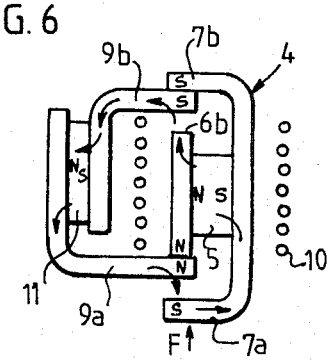

When the excitation voltage applied to the winding 10 is cut-off as shown in FIG. 6, the flux through the fixed magnet 11 is no longer opposed by the coil flux and is capable of passing normally through the half-yoke 9*a* so as to reach the pole-piece 7 across the open air-gap 9*a*–7*a*. The same process takes place across the air-gap 9*b*–6*b*. The two magnets are therefore connected in series. Furthermore, repulsive forces appear within the closed air-gaps and urge the armature in the upward direction. The armature will therefore move so as to take up the position shown in FIG. 3 (rest position).

It is seen in FIGS. 5 and 6 that the air-gaps which are closed in the operating position occupy a dissymmetrical position with respect to the respective magnets. The respective reluctances to be overcome are therefore different. Now, in order to prevent any objectionable remanence when the excitation voltage is cut-off, it is important to ensure that the resultant flux is substantially zero within said air-gaps. The respective power values of the two magnets are calculated for this purpose.

In the example described, the surface area of the fixed magnet 11 is larger than that of the movable magnet 5.

An electromagnet which is similar to the preceding but adapted to actuate the body of a valve will now be described with reference to FIG. 7.

The elements 1 to 7 and 9 to 11 already described are again shown in this figure. However, the axial cavity 3 in which the armature 4 is slidably fitted is constituted by two half-shells 102*a* and 102*b*, said half-shells being assembled together along a joint plane which carries the axis of the coil unit 1. This assembly can be made leak-tight, for example by means of an interengaged assembly which also seals-off one end of the cavity 3.

Furthermore, said half-shells are adapted to carry cheeks 102*c* so as to constitute the coil form 2.

The half-yokes 9*a* and 9*b* pass through the half-shell 102*a* and are of flat shape in order to prevent any interference with the winding operation which results in formation of the winding 10. Said half-yokes can thus be positioned with accuracy and fluid-tightness is ensured by encapsulation. This makes it necessary to place the armature 4 in position at the moment of assembly of the half-shells.

On completion of the winding operation, intermediate yokes 113*a* and 113*b* respectively are attached to the half-yokes 9*a* and 9*b* by slotting or the like, the fixed magnet 11 being clamped between said intermediate yokes.

A spring 114 which is compressed in the operating position has the shape of a flat ring inserted in the half-shell 102*b* and is prestressed on the half-shell 102*a*. Said spring has a tongue 114*a* which projects radially inwards from the ring 114 and is actuated by the end portion 7*a*. At the other end of the electromagnet, an O-ring seal 115 is force-fitted within a groove formed in an axial cylindrical projecting portion 115*a* formed conjointly by the two half-shells 102*a*, 102*b*. The projecting portion 115*a* and the O-ring seal 115 are intended to be engaged in fluid-tight manner within a recess 116*a* formed in the body 116 of a pneumatic valve. A control push-rod 117 of said valve can thus be actuated by the end portion 7*b* of the pole-piece 7 by passing through an axial bore 115*b* of the coil form 2. After assembly and adjustment, a molded encapsulation coating (not shown) serves to rigidly fix the valve body on the electromagnet and to protect the winding, thus forming an electrovalve.

It has been possible to increase the air-gap surface areas, in particular by means of enlarged portions 6*a* of the ends of the pole-piece 6 by reason of the fact that the armature is placed in position prior to assembly of the half-shells. In fact, in this embodiment, the armature need no longer be engaged axially and may therefore be greater in width at its extremities than in the zone which is surrounded by the coil form. It is also worthy of note that, in contrast to the preceding figures, the pole faces of the movable magnet 5 and of the fixed magnet 11 which are in opposite relation have the same polarities in order to minimize flux leakages in the air between these two permanent magnets.

In a conventional non-polarized electromagnet, the force obtained in the rest position is of much lower value than the force obtained in the operating position. Since only the force in the state of rest is utilized in this case and is at least equivalent to the force in the operating state, the electromagnet in accordance with the invention therefore makes it possible to obtain exceptional performances. The spring 114 serves only to obtain a higher release tension. Furthermore, in conventional hermetically-sealed plunger-type electromagnets, there is a loss of performance due to the fact that the coil flux must pass through a fluid-tight tube in order to reach the core.

Figure 8:
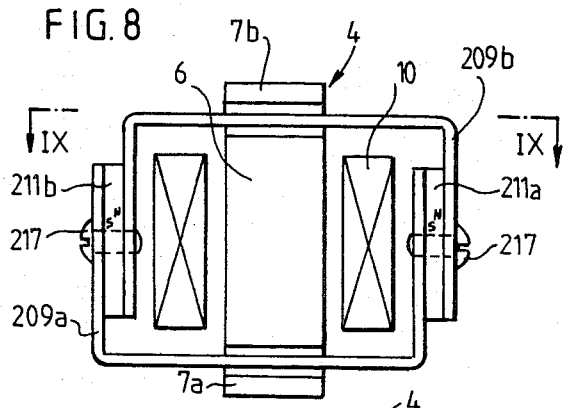
FIGS. 8, 10 and 11 are diagrammatic views in side elevation showing three further embodiments of the invention, the winding being shown in axial cross-section.
Figure 9:
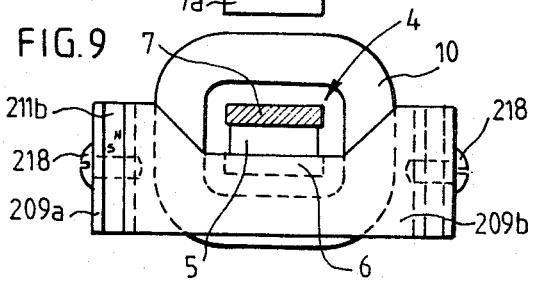
FIG. 9 is a top view of the electromagnet of FIG. 8, this view being taken in cross-section along the plane IX—IX of FIG. 8.

FIGS. 8 and 9 are diagrammatic illustrations of another relative arrangement of the magnets.

The armature 4 remains unchanged but there are two fixed magnets 211*a* and 211*b* located on each side of the coil axis. These magnets are inserted between the overlapping portions of two similar U-shaped half-yokes 209*a* and 209*b* which are adapted to engage one within the other, their bottom walls being located in opposite relation. The polarities of the magnets 211*a* and 211*b* are chosen so as to ensure that said magnets are magnetically coupled in parallel to each other, thus producing opposite polarities at the two ends of the armature 4.

Moreover, as shown in FIG. 8, the axis of the fixed magnet 211*a* or 211*b* is perpendicular to the axis of the coil. In addition (as shown in FIG. 9), the axis of the fixed magnet 211*a* or 211*b* is perpendicular to the axis of the movable magnet 5. By virtue of this arrangement, a volume of small thickness can be more completely occupied.

Should it be possible to drill holes in the fixed magnets, the two half-yokes 209*a* and 209*b* can be assembled together by means of screws 218 and the spacing between said half-yokes and the armature 4 at the level of the air-gaps can accordingly be adjusted with accuracy. Since the fixed and movable magnets are perpendicular to each other, it is possible to adjust the magnetic conditions of operation of the assembled electromagnet by delivering pulses from a powerful magnetic field selectively along the axis of the movable magnet 5 or the fixed magnets 211*a*–211*b* in order to modify the residual flux density of these magnets to a slight extent.

Figure 10:
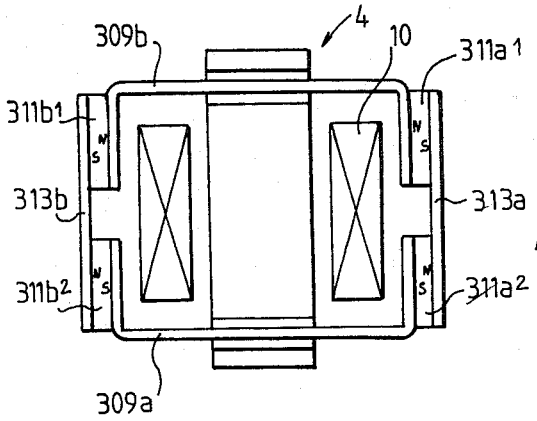

In FIG. 10, there is shown diagrammatically an alternative embodiment of FIG. 8. On each side of the coil, there are two fixed magnets 311*a*1–311*a*2 and 311*b*1–311*b*2 respectively which are coupled magnetically in series by means of a flat intermediate yoke 313*a* and 313*b* respectively.

By virtue of this arrangement, the fixed magnets are brought closer to the air-gap zones while facilitating the condition of non-remanence referred-to earlier. In addition, the fields of the half-yokes 309*a*, 309*b* are wholly symmetrical.

Figure 11:
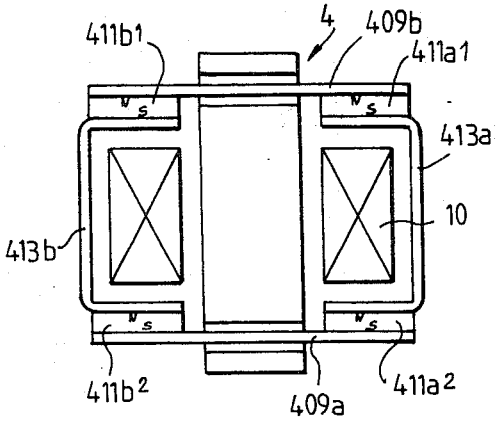

FIG. 11 is similar to FIG. 10 except for the fact that the axes of the four fixed magnets 411*a*1–411*a*2 and 411*b*1–411*b*2 are parallel to the coil axis whilst the intermediate yokes 413*a* and 413*b* are bent-back at both ends. The fixed magnets can thus be brought even closer to the air-gap zones. However, the relative spacing of the half-yokes 409*a* and 409*b* is dependent on the thickness of the magnets if suitable steps are not taken.

In the case of ferrite magnets formed by sintering and grinding, it is difficult to obtain thicknesses of less than 2 mm. Furthermore, the cost of a magnet of this type depends on its volume only to a slight extent in the case of small components. In the case of miniature electromagnets or those provided with a number of fixed magnets as described in the foregoing, it is therefore an advantage to make use of magnets fabricated from flexible magnetic material in strip or sheet form such as a rubber strip incorporating ferrite powder which has been disposed anisotropically.

It has been found that the large surface areas available between the half-yokes made it possible to employ this material for fixed magnets without any loss of performance with respect to sintered magnets. Even in the case of the movable magnet, the length required for the winding 10 permits the use of this material. All desired magnet shapes may thus be contemplated without entailing any substantial tooling costs, even for small production batches. Holes can be made for attachment, for example by means of screws as shown in FIGS. 8 and 9, or by means of rivets.

Figure 12:
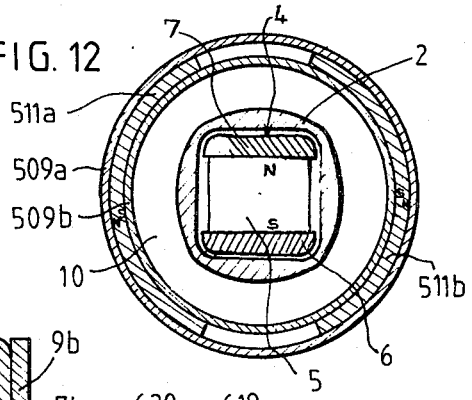
FIG. 12 is a transverse sectional view of a sixth embodiment of the electromagnet, the winding having been omitted from the figure.

Finally, flexible magnets make it possible to give the shape of concentric cylinders to the overlapping portions of the two half-yokes, thus leaving between them an annular space for the introduction of one or a number of sheets of magnetic rubber curved in the shape of tiles as shown in the sectional view of FIG. 12. This figure illustrates two fixed magnets 511*a* and 511*b* between the concentric half-yokes 509*a* and 509*b* with an internal space which is unoccupied in order to provide clearance for the tolerances of the magnets.

Figure 7:
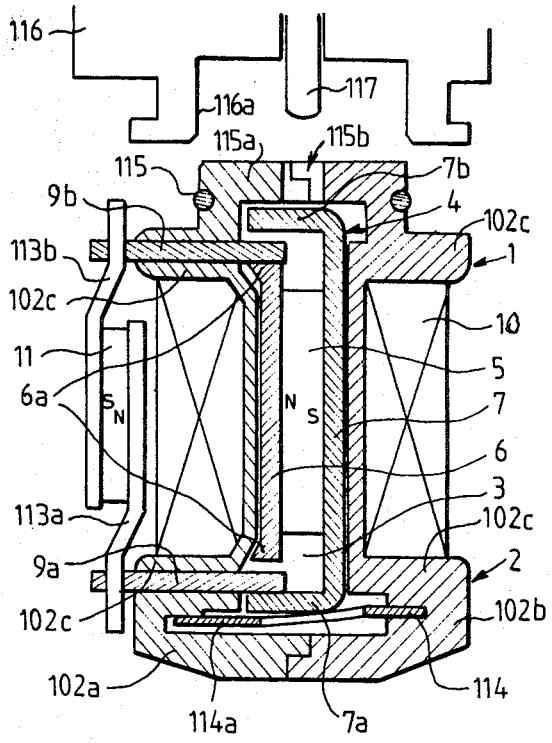
FIG. 7 is a longitudinal sectional view of a second embodiment of the electromagnet which is intended to form part of an electrovalve.
Figure 13:
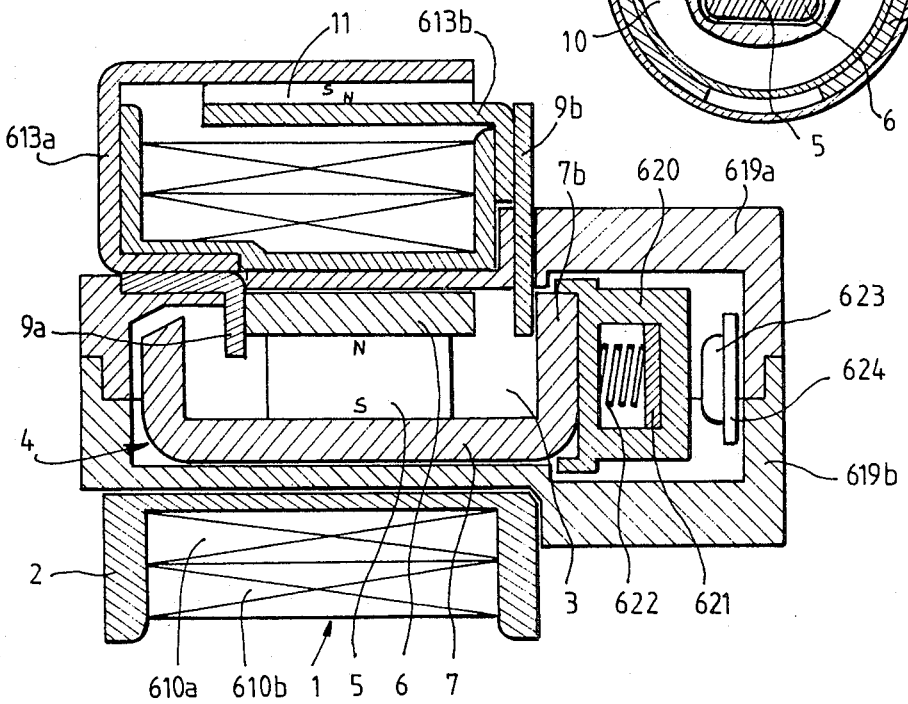
FIG. 13 is a longitudinal sectional view of an enclosed relay.

Finally, FIG. 13 is a sectional view showing an electromagnet which is similar to that of FIG. 7 but is intended to actuate a power contact housed within the interior of the closed cavity 3 in which the armature 4 is capable of moving.

The half-shells 619*a* and 619*b* which delimit the axial cavity 3 are not provided with coil cheeks. The half-yoke 9*b* has a free face at right angles to the axis of the coil unit 1 whilst the half-yoke 9*a* is bent-back at right angles so as to bring one of its faces level with the exterior of the half-shell 619*a* in a direction parallel to the axis of the coil unit 1.

In addition, two intermediate yokes 613*a* and 613*b* between which is inserted a fixed magnet 11 are fixed on the coil form 2 after winding.

When the coil unit 1 thus equipped is fitted by sliding over the body formed by the two assembled half-shells 619*a*–619*b*, opposite faces of the components 9*a*, 613*a* and 9*b*, 613*b* respectively serve to bring the magnetic polarities of the fixed magnet 11 into the interior of the cavity 3. The coil unit is thus made interchangeable.

Finally, an insulating stirrup-member 620 is attached to the end portion 7*b* of the pole-piece 7, said stirrup-member being adapted to carry a movable contact bridge 621 which is held in position by a spring 622 in a conventional manner.

Two stationary contacts 623 (only one contact being visible in the figure) are carried by stationary strips 624 which pass through the half-shells. These through-passages (not shown) can be made in the joint plane of the assembly of the half-shells as shown in the figure or in a perpendicular plane.

The half-shells can be of insulating material or of alloy molded under pressure, in which case provision is made for insulation of the through-passages provided for the stationary strips 624.

The electric contact is thus protected against dust particles or against an aggressive environment and there is no moving part outside the cavity 3. Furthermore, if the cavity 3 is hermetically closed, a suitably chosen gaseous atmosphere having a predetermined pressure or else a liquid such as oil makes it possible to employ contacts made of metals which are less noble than silver or alternatively to obtain higher dielectric strength.

As shown in FIG. 13, the winding 10 is split-up in a conventional manner into two concentric windings 610*a* and 610*b*. By way of example, one of the windings (610*a*) may be assigned to attraction of the contactors and the other winding (610*b*) may be assigned to holding in this position by means of a switch (not shown). In the case of short-circuit detection when using overcurrent circuitbreakers, it is an advantage to open the contacts as rapidly as possible in order to prevent the current from attaining its peak value. In order to obtain opening at a higher speed than that achieved by interruption of the holding current, the electromagnet in accordance with the invention makes it possible to produce a restoring force of higher value than the restoring force provided by fixed and movable magnets in opposition, this result being achieved by passing into the electromagnet a current having a direction opposite to that of the normal excitation. In the case of a double winding, this operation can be performed simply by abruptly delivering a capacitor discharge into the attraction winding and then cutting-off the hold winding with a time constant which is necessarily longer. In fact, only the resultant in ampere-turns has an influence on the armature.

In FIG. 13, there is shown only a single fixed magnet 11 which is parallel to the movable magnet 5. As will be readily apparent, however, it would also have been possible to make use of one of the arrangements shown in FIGS. 8 to 11. The same applies to FIG. 7.

The invention is not limited to the examples described in the foregoing but covers all structures embodying the arrangements described in the introductory part of claim 1.

In particular, the invention applies to electeromagnets having an H-section armature with unbent pole-pieces which are capable of rotational displacement as described in French Pat. No. 2,486,303 or of translational displacement in a direction parallel to the axis of the movable magnet.

What is claimed is :

1. An electromagnet equipped with a moving system including a permanent magnet and designed for monostable operation, comprising at least one coil which partly surrounds a magnetic circuit consisting of a fixed yoke and a movable armature, said armature being constituted by a permanent magnet having pole faces adapted to carry pole-pieces which project on each side of the axis of magnetization of the magnet so as to constitute in conjunction with the end portions of the fixed yoke two air-gap zones in which magnetic forces are developed and tend to displace the armature to either of its two end positions according as the coil is energized in a suitable direction or is not energized, wherein said electromagnet comprises a second permanent magnet interposed within the fixed yoke with a polarity such that said armature is urged towards the end or so-called rest position when the coil is not energized.

2. An electromagnet according to claim 1, wherein the magnets are separated from each other by the coil in all the relative positions of said magnets.

3. An electromagnet according to claim 1 wherein the yoke is constituted by two half-yokes arranged in partly overlapping relation and each surrounding one end of the coil in order to cooperate with pole-pieces, at least one pole-piece being provided with bent-back end portions, said pole-pieces being capable of moving transversely to the axis of the movable magnet and being slidably fitted within said coil and wherein the fixed magnet is secured between the overlapping portions of said half-yokes.

4. An electromagnet according to claim 1 wherein said electromagnet comprises two half-shells defining together an axial cavity in which the armature is slidably mounted, said half-shells being assembled along a plane which passes through the axis of the coil and wherein at least one of said half-shells is traversed by two half-yokes between which the fixed magnet is interposed.

5. An electromagnet according to claim 4, wherein the two half-shells are assembled together in fluid-tight manner and wherein the two ends of the axial cavity are closed in fluid-tight manner so as to ensure that said cavity is hermetically sealed.

6. An electromagnet according to claim 5, wherein one end of the axial cavity is formed on the body of a valve having a control push-rod which can be actuated by the armature so as to constitute an electrovalve.

7. An electromagnet according to claim 5, wherein at least one electric contact is disposed within the axial cavity, is provided with fluid-tight insulating through-passages and can be actuated by the armature so as to constitute an enclosed contact in a controlled atmosphere.

8. An electromagnet according to claim 7, wherein one of the half-yokes is bent-back at right angles so that one face thereof is flush with the exterior of the corresponding half-shell in a direction parallel to the axis of the coil and wherein said coil is adapted to carry two intermediate yokes between which is inserted at least one fixed magnet and each having one face which comes into contact respectively with a corresponding face of the half-yokes when said coil is slidably fitted on the body constituted by the two half-shells, said half-shells being assembled so as to make the coils interchangeable.

9. An electromagnet according to claim 4, wherein the half-shells are provided with cheeks in order to constitute the coil form.

10. An electromagnet according to claim 1 wherein at least one of the movable or fixed magnets is fabricated from flexible magnetic material in strip form or sheet form such as a strip of anisotropic magnetic rubber.

11. An electromagnet according to claim 10, wherein the overlapping portions of the two half-yokes have the shape of concentric cylinders, there being left between said cylinders an annular space in which is introduced at least one magnetic rubber sheet curved in the shape of a tile.

12. An electromagnet according to claim 1, wherein the means for controlling the return of the coil to its rest position comprise means for reversing the direction of the field produced by said coil.

13. An electromagnet according to claim 12, comprising a coil unit having two windings such that one winding serves to produce an attractive force whilst the other winding subsequently produces a holding action, wherein the means for reversing the direction of the field produced by the coil comprise means for energizing the attraction winding in a direction opposite to the direction which had produced the attractive force as well as means for interrupting the current within the hold winding.

14. An electromagnet according to claim 1, wherein said magnet comprises two fixed magnets coupled in parallel and mounted on each side of the coil.

15. An electromagnet according to claim 1, wherein each fixed magnet is constituted by an assembly comprising two magnets mounted in series and joined together by means of an intermediate yoke.

16. An electromagnet according to claim 15, wherein the magnetic axis of the two magnets of each assembly is parallel to the coil axis, wherein said two magnets are each mounted at one end of said coil and wherein the intermediate yoke which joins them together is bent-back at right angles at both ends.

17. An electromagnet according to claim 1, wherein the axes of the movable magnet and of the fixed magnet are parallel to each other and wherein the pole faces of the movable magnet and of the fixed magnet which are located in opposite relation have the same polarity.

18. An electromagnet according to claim 1, wherein the axes of the movable magnet and of the fixed magnet are at right angles to each other.

19. A method for adjusting the magnetic conditions of operation of an electromagnet according to claim 18, wherein pulses of an external magnetic field are delivered selectively to the movable magnet or to the fixed magnet.

* * * * *